United States Patent [19]

Egli

[11] 4,365,715

[45] Dec. 28, 1982

[54] PACKAGE ASSEMBLY AND METHOD OF PACKAGING

[75] Inventor: Alwin Egli, Beringen, Switzerland

[73] Assignee: SIG-Schweizerische Industrie-Gesellschaft, Neuhausen am Rheinfall, Switzerland

[21] Appl. No.: 232,418

[22] Filed: Feb. 6, 1981

[30] Foreign Application Priority Data

Feb. 15, 1980 [CH] Switzerland ..... 1275/80

[51] Int. Cl.[3] ..... B65D 85/72; B65D 51/16; B65B 63/02

[52] U.S. Cl. ..... 206/524.8; 206/386; 229/62.5; 53/432

[58] Field of Search ..... 206/524.8, 497, 386; 229/62.5; 53/432, 403

[56] References Cited

U.S. PATENT DOCUMENTS

| | | | |
|---|---|---|---|
| 2,606,704 | 8/1952 | Nichols | 206/524.8 |
| 2,638,263 | 5/1953 | Jesnig | 229/62.5 |
| 2,709,519 | 5/1955 | Cushman | 206/524.8 |
| 3,429,095 | 2/1969 | Huson | 206/497 |
| 3,943,987 | 3/1976 | Rossi | 206/524.8 |

*Primary Examiner*—William T. Dixson, Jr.
*Attorney, Agent, or Firm*—Spencer & Kaye

[57] ABSTRACT

A package assembly has a group formed of a plurality of individual, gas-pervious packages; a gas-impervious wrapper surrounding the group airtight; and a one-way pressure relief valve affixed to the wrapper for discharging gases from the space between the wrapper and the individual packages.

10 Claims, 6 Drawing Figures

Fig. 1
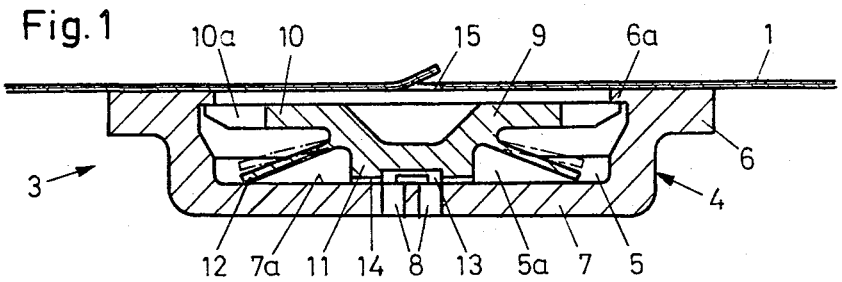
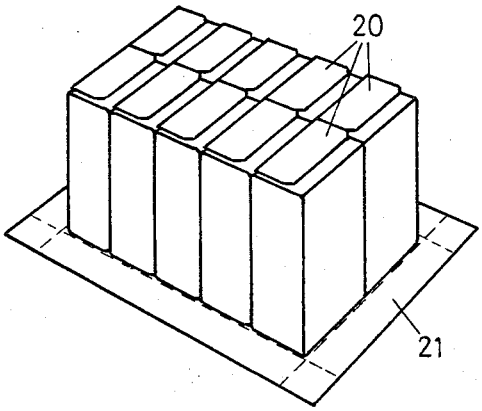
Fig. 2
Fig. 3
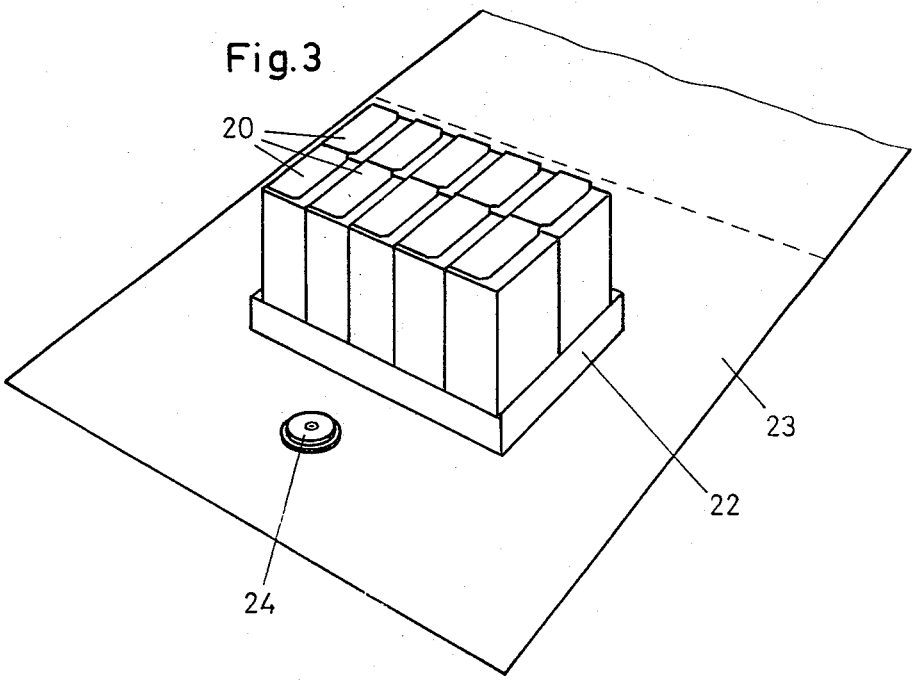

PACKAGE ASSEMBLY AND METHOD OF PACKAGING

BACKGROUND OF THE INVENTION

This invention relates to a package assembly which includes a group of usually rectangular, individual, gas-pervious packages and an outer wrapper enveloping the group. The content of the individual packages is gas-releasing, such as freshly roasted coffee.

Conventionally, roasted coffee beans are packaged in gastight simple bags for preserving their flavor. Because of the natural gas emission of freshly roasted coffee, the bags inflate and appear to the customers as incompletely filled packages. If, on the other hand, the bags are not gastight to thus permit the gas, particularly carbon dioxide, to escape, at the same time the aromatic substances also escape. Further, a gas exchange may take place, as a result of which oxygen may enter into the bags which, as known, leads to an accelerated decomposition of certain aromatic substances. For this reason the bags have to be sold within a certain period of time within which at the most only a small amount of inflation of the bag may be noticed or before the released gas entrains with it aromatic substances to an appreciable extent.

In packaging foodstuff in vacuumtight foil bags it is known, as disclosed, for example, in U.S. Pat. No. 2,638,263, to incorporate in the wrapper a check valve through which air is evacuated from the bag, but which subsequently prevents air from entering the bag from the environment.

It is further known, as disclosed in Swiss Pat. No. 561,132, to wrap articles in gastight shrinking foils and to evacuate the package prior to sealing it gastight.

Packaging of roasted coffee according to the two above-outlined exemplary possibilities has several disadvantages. To provide each individual bag with its own relief valve is very expensive. Such a packaging needs new packing machines which, in a high-output operation, have to provide for the supply and sealing of the individual relief valves to the single bags. In present-day bagging machines which operate with high-frequency cycles, such an additional operation could, in any event, be performed only with difficulty, if at all. On the other hand, a shrinking foil package may be used only in connection with foodstuff which does not release any gases, otherwise the above-noted disadvantageous bloating of the package will occur.

SUMMARY OF THE INVENTION

It is an object of the invention to provide an improved packaging which extends the present several-day storage period to over two months and which permits the continued use of present-day filling and packing machines without the necessity of making structural changes therein.

This object and others to become apparent as the specification progresses, are accomplished by the invention, according to which, briefly stated, the package assembly comprises a plurality of gas-pervious individual packages which are enveloped by a sealed gastight wrapper provided with a relief valve for discharging the gases released by the contents of the gas-pervious individual packages.

BRIEF DESCRIPTION OF THE DRAWINGS

FIG. 1 is a sectional elevational view of a one-way relief valve of conventional structure.

FIGS. 2 through 5 are perspective views showing in sequence various operational phases in preparing the package assembly according to the invention.

DESCRIPTION OF THE PREFERRED EMBODIMENT

Figure 4:
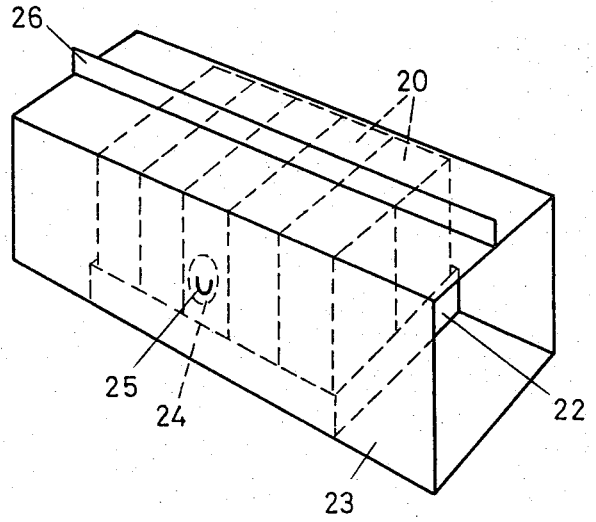

Turning first to FIG. 1, there is illustrated a pressure relief valve 3 which is of conventional construction and which is particularly adapted for use in the package assembly according to the invention. The valve 3 has a flat cylindrical housing 4 which defines an inner space 5 and which has a radially outwardly extending flange 6 and a radially inwardly extending collar 6*a* projecting from the flange 6. The housing 4 further has a bottom 7 about the center of which there are provided a plurality of apertures 8. In the space 5 there is accommodated a valve body 9 which has at its upper part a plurality of arms 10 formed from a circular disc by circumferentially arranged, radially inwardly extending slots 10*a*. The arms 10 project below the collar 6*a*. The lower part of the valve body 9 has a cylindrical projection 11 which engages the bottom face 7*a*. The valve body 9 is clamped and centered by the arms 10 between the bottom face 7*a* and the collar 6*a*. The valve body 9 carries a circular sealing lip 12. In its installed, normal state the lip 12 sealingly presses on the bottom face 7*a* (full-line position) and in case the pressure in a valve chamber 5*a* exceeds a predetermined value, the lip 12 yields and thus moves away from the bottom face 7*a* to assume a discharging position (shown in phantom lines). Communication between the openings 8 and the valve chamber 5*a* is maintained by a centrally arranged cavity 13 through radial connecting channels 14. The relief valve 3 is covered by a wrapper 1 which has a semicircular slot 15 aligned approximately with the center of the valve body 9. The relief valve 3 is sealed to the inner face of the wrapper 1 at the flange 6. Thus, the gas present in the space enclosed by the wrapper 1 enters into the valve chamber 5*a* through the openings 8, the cavity 13 and the connecting channels 14. If within the package (that is, in the space enclosed by the wrapper 1) an excessive gas pressure is generated, the same pressure will prevail in the valve chamber 5*a* and, as a result, the sealing lips 12 will be lifted as shown in phantom lines in the structure illustrated in FIG. 1. Consequently, gas may escape from the valve through the slots 10*a* and may leave the package through the opening 15 provided in the wrapper 1.

It will be readily seen that a relief valve of the above-described type is simple to manufacture and its operational reliability is adequate for use in the food packaging industry.

The invention resolves the earlier-discussed problem of providing each individual bag with its own relief valve. According to the invention, there is provided a package assembly in which the bags constituting the individual packages are gas-pervious and may be provided, as before, with a rolled-in closure since a gas release from the individual packages is intended.

Turning now to FIGS. 2 through 6, there are shown five sequential operational stages of the manufacture of a package assembly, for example, for a group of ten individual bags or boxes.

According to FIG. 2, the individual packages 20 are positioned on a flat, hot melt-bonded cardboard tray blank 21. It is to be understood that the number and arrangement of the individual packages is exemplary and it is thus feasible to place a greater number of individual packages in each row on the tray and/or to arrange the individual packages in more than one layer.

As shown in FIG. 3, the side flaps of the tray blank have been turned upward and bonded together to provide a more rigid tray structure 22. As further shown in FIG. 3, a wrapper length 23, which may be taken from a reel, is positioned underneath the tray 22. To the wrapper length 23 there is bonded a pressure relief valve 24 which may correspond in structure to the relief valve 3 described in connection with FIG. 1.

As seen in FIG. 4, the individual packages 20 and the tray 22 are wrapped in the wrapper 23 which, in this stage, is of a tubular configuration and is provided with a gastight fin-seal 26. It is noted that from the outside of the package assembly the relief valve 24 is not visible; its location can be determined by the presence of the semicircular slot 25 provided in the wrapper 23.

Figure 5:
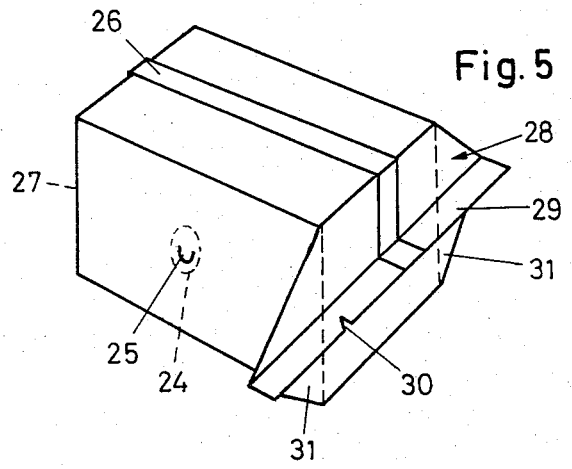

Turning to FIG. 5, after folding and spreading the two ends of the tubular wrapper, the rear end 27 (FIG. 5) is sealed airtight by a fin seal and the lateral triangular ears are folded inwardly. At the frontal end 28 the frontal fold is first bonded by several sealing points so that a gas-pervious transverse seam 29 is obtained to permit an evacuation of the wrapped package and a filling with an inert gas, such as carbon dioxide. When the seam 29 is formed, a tear-open notch 30 is also provided therein. As an alternative, there may be provided a tear-open strip on wrapper 23 during its preparation, for example, simultaneously with the application of the relief valve 24.

Figure 6:
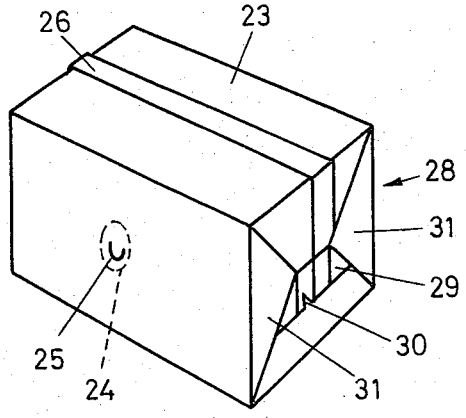
FIG. 6 is a perspective view of a completed package assembly according to the invention.

After evacuation and filling with gas, the seam 29 is sealed gastight, the triangular lateral flaps 31 are folded inwardly and glued to the frontal face of the package assembly to obtain the completed article as shown in FIG. 6.

With the package assembly according to the invention the period during which the contents remain fresh is substantially lengthened. While in case of conventional packaging as outlined above, the time between the roasting of the coffee and the delivery for sale should not exceed one week, such period is extended to two to three months with the package assembly according to the invention. This permits a more favorable utilization of the production and packaging capacity and further, at all times sufficiently large stock is available for high demand peaks. During storage, carbon dioxide may diffuse from the freshly roasted coffee and accumulate in the outer wrapper 23 from which it may escape through the relief valve 24.

For making the package assembly according to the invention, a further machine may be used in addition to the usual filling and packing machines.

It is to be understood that while in the exemplary embodiment a sealed and folded wrapper is described as the outer envelope of the package assembly, the invention may be practiced with prefabricated bags as well.

It will be understood that the above description of the present invention is susceptible to various modifications, changes and adaptations and the same are intended to be comprehended within the meaning and range of equivalents of the appended claims.

What is claimed is:

1. A package assembly comprising in combination:
   (a) a group formed of a plurality of individual, gas-pervious packages;
   (b) a gas-impervious wrapper surrounding said group airtight; and
   (c) a one-way pressure relief valve affixed to said wrapper for discharging gases from the space between said wrapper and said individual packages.

2. A package assembly as defined in claim 1, further comprising a supporting base on which said individual packages are supported.

3. A package assembly as defined in claim 2, wherein said supporting base is a tray having a bottom part and marginal flaps bent perpendicularly with respect to the bottom part towards said individual packages; said flaps being glued to one another.

4. A package assembly as defined in claim 1, wherein said support base is of hot melt-bonded cardboard.

5. A package assembly as defined in claim 1, wherein said wrapper has an airtight longitudinal seam and two airtight transverse seams.

6. A package assembly as defined in claim 1, wherein said package assembly has a rectangular configuration having top, bottom and side faces; said relief valve being arranged on one of said side faces.

7. A package assembly as defined in claim 1, further including means on said wrapper for facilitating a tearing-open of said wrapper.

8. A method of making a package assembly, comprising the following steps:
   (a) arranging a plurality of individual packages on a supporting base;
   (b) wrapping the individual packages and the supporting base as a group into a wrapper provided with a pressure relief valve;
   (c) folding together longitudinal edges of the wrapper and sealing said longitudinal edges to form an open-ended tubular envelope about said group;
   (d) folding and sealing airtight one end of the tubular envelope and folding and partially sealing the other end of the tubular envelope;
   (e) evacuating the space surrounded by the wrapper through the partially sealed said other end; and
   (f) sealing airtight said other end.

9. A method as defined in claim 8, further comprising the step of filling said space, subsequent to the evacuating step, with an inert gas.

10. A method as defined in claim 8, wherein step (f) is started during the performance of step (e).

* * * * *